US012509126B2

(12) United States Patent
Dür et al.

(10) Patent No.: US 12,509,126 B2
(45) Date of Patent: Dec. 30, 2025

(54) CABLEWAY HAVING CAR STABILIZATION

(71) Applicant: Innova Patent GmbH, Wolfurt (AT)

(72) Inventors: Gerd Dür, Bildstein (AT); Magnus Zündel, Andelsbuch (AT); Jürgen Eberle, Alberschwende (AT)

(73) Assignee: Innova Patent GmbH, Wolfurt (AT)

( * ) Notice: Subject to any disclaimer, the term of this patent is extended or adjusted under 35 U.S.C. 154(b) by 693 days.

(21) Appl. No.: 17/905,045

(22) PCT Filed: Feb. 24, 2021

(86) PCT No.: PCT/EP2021/054484
§ 371 (c)(1),
(2) Date: Aug. 26, 2022

(87) PCT Pub. No.: WO2021/170598
PCT Pub. Date: Sep. 2, 2021

(65) Prior Publication Data

US 2023/0088063 A1 Mar. 23, 2023

(30) Foreign Application Priority Data

Feb. 26, 2020 (AT) ..... A 50140/2020

(51) Int. Cl.
*B61B 1/02* (2006.01)
*B61B 10/02* (2006.01)
(Continued)

(52) U.S. Cl.
CPC ..... *B61B 1/02* (2013.01); *B61B 10/027* (2013.01); *B61B 12/005* (2013.01); *B61B 12/04* (2013.01)

(58) Field of Classification Search
CPC .. B61B 12/04; B61B 7/04; B61B 1/02; B61B 10/027; B61B 11/004
(Continued)

(56) References Cited

U.S. PATENT DOCUMENTS 3,170,412 A * 2/1965 Sowder ..... B61B 12/04 105/149.2
3,742,864 A 7/1973 Frech
(Continued)

FOREIGN PATENT DOCUMENTS

AT 388901 B * 9/1989 ..... B61B 12/04
AT 395965 B * 4/1993 ..... B61B 12/028
(Continued)

OTHER PUBLICATIONS

International Preliminary Report on Patentability; Application No. PCT/EP2021/054484; Completed: Nov. 12, 2021; Jan. 17, 2022; 17 Pages.
(Continued)

*Primary Examiner* — S. Joseph Morano
(74) *Attorney, Agent, or Firm* — Husch Blackwell LLP

(57) ABSTRACT

A cableway in the case of which the safety and comfort for persons during the loading and unloading of the cableway vehicles can be improved as simply and economically as possible. This aim is achieved, according to the teaching, in that at least one vehicle-fixed contact rail which extends in the direction of movement of the cableway vehicle is arranged on the conveying body, and in that at least one guiding portion having at least one stationary first guiding device which extends in the direction of movement of the cableway vehicle is provided in at least one cableway station, the first guiding device cooperating with the contact rail of the cableway vehicle, at least during the movement of the cableway vehicle through the guiding portion, in order to generate a guiding force, the guiding force shifting the conveying body relative to the suspension from a rest position, in which the cableway vehicle can be moved outside of the guiding portion, into a guidance position, in
(Continued)

which the cableway vehicle can be moved through the guiding portion.

17 Claims, 4 Drawing Sheets

(51) Int. Cl.
*B61B 12/00* (2006.01)
*B61B 12/04* (2006.01)

(58) Field of Classification Search
USPC ..... 104/180; 105/149.1, 149.2
See application file for complete search history.

(56) References Cited

U.S. PATENT DOCUMENTS

| | | | | |
|---|---|---|---|---|
| 6,729,241 | B2 | 5/2004 | Gabriel et al. | |
| 6,862,998 | B2 * | 3/2005 | Doppelmayr | B61B 12/04 105/149.1 |
| 7,082,880 | B2 * | 8/2006 | Schertler | B61B 12/04 105/194.1 |
| 2024/0001968 | A1 * | 1/2024 | Hoeck | B61B 12/04 |

FOREIGN PATENT DOCUMENTS

| | | | |
|---|---|---|---|
| CA | 2546915 | A1 | 3/2007 |
| CN | 2652745 | Y | 11/2004 |
| CN | 102463997 | A | 5/2012 |
| CN | 107985328 | A | 5/2018 |
| EP | 1424257 | A1 | 6/2004 |
| EP | 1752352 | A2 | 2/2007 |
| EP | 1767425 | A1 | 3/2007 |
| EP | 1671867 | B1 | 10/2008 |
| EP | 3299243 | A1 | 3/2018 |
| EP | 3299243 | B1 | 5/2019 |
| JP | H08133070 | A | 5/1996 |
| JP | 2905707 | B2 | 6/1999 |

OTHER PUBLICATIONS

International Search Report and Written Opinion of the International Searching Authority; Application No. PCT/EP2021/054484; Completed: May 28, 2021; Mailing Date: Jun. 8, 2021; 11 Pages.
Office Action dated Apr. 29, 2023 for Chinese Patent Application No. 202180016848.1.

* cited by examiner

CABLEWAY HAVING CAR STABILIZATION

TECHNICAL FIELD

The present teaching relates to a cableway having at least two cableway stations and at least one cableway vehicle that can be moved between the cableway stations using a traction cable, the cableway vehicle having a conveying body and a suspension, the conveying body serving to accommodate persons and/or objects, and the conveying body being suspended in a spring-loaded manner on the suspension. The present teaching also relates to a method for operating a cableway having at least one cableway vehicle that can be moved between the cableway stations using a traction cable.

BACKGROUND

Cableway systems are used to transport persons and materials between two or more cableway stations. For this purpose, a plurality of cableway vehicles, such as chairs or cable cars, is moved between the cableway stations, either circulating or shuttling back and forth. The cableway vehicles are moved between the cableway stations by means of at least one traction cable. The cableway vehicle can be suspended from at least one fixed cable or from the traction cable (aerial cableways), or can be movably arranged on rails or on the ground (standing cableways), and can be moved with at least one traction cable. However, the cableway vehicle can also be releasably or fixedly clamped to the traction cable and be moved with the traction cable. In the case of circulating cableways, the cableway vehicles are often uncoupled from the traction cable in a cableway station, for example by means of releasable cable clamps, and are moved through the cableway station at a lower speed, in order to make it easier for persons to board or disembark or to make it easier to load or unload material.

A known practice is that of actuating certain functions of cableways—for example, opening or closing a cable clamp, raising, or lowering a safety bar or a weather protection hood of a chair, or opening and closing a door of a cable car or gondola in a cableway station—via link controls. For this purpose, a link is arranged so as to be stationary relative to the station, and a contact element on the cableway vehicle contacts the link when it passes through the station. The contact element is arranged on a rotatably mounted lever which is pivoted upon the contact. The specific function is then carried out via a Bowden cable or an arrangement of rods acting on the lever. An example of the opening and closing function of a door can be found in U.S. Pat. No. 3,742,864 A, and EP 1 671 867 B1 shows an example of a safety bar being raised and lowered.

In particular in the case of cable cars or gondolas as cableway vehicles, said cableway vehicle can swing in the cableway station when persons board or disembark because there is play between the platform and the cableway vehicle. The cableway vehicle may also sink or rise in the cableway station due to the weight of the persons boarding or disembarking. Such relative movements of the cableway vehicle relative to the platform can be uncomfortable for persons boarding or disembarking and impair the safety of the cableway operation. Similar problems can also arise in material transport.

EP 3 299 243 B1 discloses a cableway with a cableway station in which a cable car is moved longitudinally between two floor guide rails. To avoid blocking the cable car, the distance between the floor guide rails in the transverse direction is greater than the width of the cable car. This causes the cable car to swing in the transverse direction, in particular when boarding the cable car, which results in the cable car hitting the floor guide rails and in a lack of sense of safety on the part of the passengers. In order to avoid this, EP 3 299 243 B1 proposes that, in the region of the boarding platform, the cable car be blocked by a blocking apparatus in the transverse direction. The blocking apparatus can be designed as a downwardly extending pin which is arranged centrally on the floor of the cable car and cooperates with a clamping rail arranged on the floor of the cableway station. As a result, the cable car is fixed in a central position between the floor guide rails in the transverse direction. However, the blocking apparatus can also be designed as an active slider that is integrated into the boarding platform. The slider can be controlled by an electric motor and can be pressed in the transverse direction against a cable car standing in the region of the platform in order to press the cable car against the opposite floor guide rail. However, this has the disadvantage that this is only possible when the cable car is at a standstill and, in addition, the structural design is very complex.

SUMMARY

Based on the prior art, it is therefore an object of the present teaching to specify a cableway in which the safety and comfort for persons when loading and unloading the cableway vehicles can be improved as simply and economically as possible.

This object is achieved according to the present teaching in that at least one vehicle-fixed contact rail which extends in the direction of movement of the cableway vehicle is arranged on the conveying body, and in that at least one guiding portion having at least one stationary first guiding device which extends in the direction of movement of the cableway vehicle is provided in at least one cableway station, the first guiding device cooperating with the contact rail of the cableway vehicle, at least during the movement of the cableway vehicle through the guiding portion, in order to generate a guiding force, the guiding force shifting the conveying body relative to the suspension from a rest position, in which the cableway vehicle can be moved outside of the guiding portion, into a guidance position, in which the cableway vehicle can be moved through the guiding portion. As a result, on the one hand, lateral pendulum movements of the conveying body in the region of the loading and unloading regions can be reduced, in particular prevented, as a result of which the safety of the passengers when boarding and disembarking the cableway vehicle can be increased. In addition, pendulum movements of the conveying body in the direction of movement of the cableway vehicle can be reliably reduced. The spring-loaded suspension of the conveying body is therefore deliberately used in order to shift the conveying body from the rest position into a guidance position relative to the suspension. Due to the fact that, in the guidance position, a restoring force acts on the cableway vehicle which wants to move the cableway vehicle back into the rest position against the guiding force and the guides that work together and prevent the return, a stabilization of the cableway vehicle takes place in the transverse and longitudinal directions.

It can be advantageous if at least two vehicle-fixed contact rails which extend in the direction of movement of the cableway vehicle and are spaced apart from one another transversely to the direction of movement are arranged on the conveying body, and that at least two stationary first guiding devices are provided in at least one guiding portion, in each case one of the first guiding devices cooperating with a contact rail in order to generate the guiding force. As a result, the guiding force acts on the conveying body in the transverse direction at a plurality of points, as a result of which a purely vertical shifting of the conveying body relative to the suspension can substantially be achieved.

It is advantageous if at least one first guiding device is designed as a ceiling guide rail which is arranged on a stationary structure in the upper region of the cableway station and that the corresponding contact rail is arranged in an upper lateral region on the cableway vehicle. This arrangement is advantageous because the contact rail and the ceiling guide rail cooperate in a region that is not easily accessible to passengers and staff. As a result, safety can be increased for passengers and staff.

Preferably, at least one guiding portion is provided with at least one stationary second guiding device which extends in the direction of movement of the cableway vehicle, with the conveying body being deflected in the direction of the second guiding device by means of the guiding force in the region of the guiding portion, with the second guiding device cooperating with a part of the cableway vehicle in the region of the guiding portion in order to guide the cableway vehicle, at least one second guiding device preferably being designed as a floor guide rail which is arranged on a stationary structure in the lower region of the cableway station. As a result, the cableway vehicle is guided on both sides, as a result of which the stabilization of the cableway vehicle in the transverse direction can be further improved.

At least one first guiding device and/or at least one second guiding device is/are advantageously designed as a slide rail and/or a plurality of rotatably mounted rollers is arranged one behind the other in the direction of movement of the cableway vehicle on at least one first guiding device and/or on at least one second guiding device. As a result, the friction between the ceiling guide rail and the contact rail can be reduced, and the cableway vehicle can be guided smoothly.

At least one first guiding device and/or at least one second guiding device preferably has a damping apparatus and/or the at least one contact rail has a damping apparatus. As a result, impacts on the cableway vehicle that can occur, for example, when driving into the guiding portion, can be cushioned, and dampened.

The conveying body is preferably designed as a cable car. As a result, the present teaching can be advantageously used in a gondola cableway.

Furthermore, the object is achieved with a method for operating a cableway in that the cableway vehicle is moved into a guiding portion of a cableway station, with a stationary first guiding device of the cableway station, which guiding device extends in the direction of movement of the cableway vehicle, cooperating, during the movement of the cableway vehicle through the guiding portion, with a vehicle-fixed contact rail, which is arranged on the conveying body and which extends in the direction of movement of the cableway, in order to generate a guiding force, the conveying body being moved, during the movement through the guiding portion, relative to the suspension from a rest position, in which the cableway vehicle is moved outside of the guiding portion, into a guidance position, in which the cableway vehicle is moved through the guiding portion, by means of the guiding force.

BRIEF DESCRIPTION OF THE DRAWINGS

The present teaching is described in greater detail below with reference to FIGS. 1 to 4 which show exemplary, schematic, and non-limiting advantageous embodiments of the present teaching. In the drawings.

DETAILED DESCRIPTION

Figure 1:
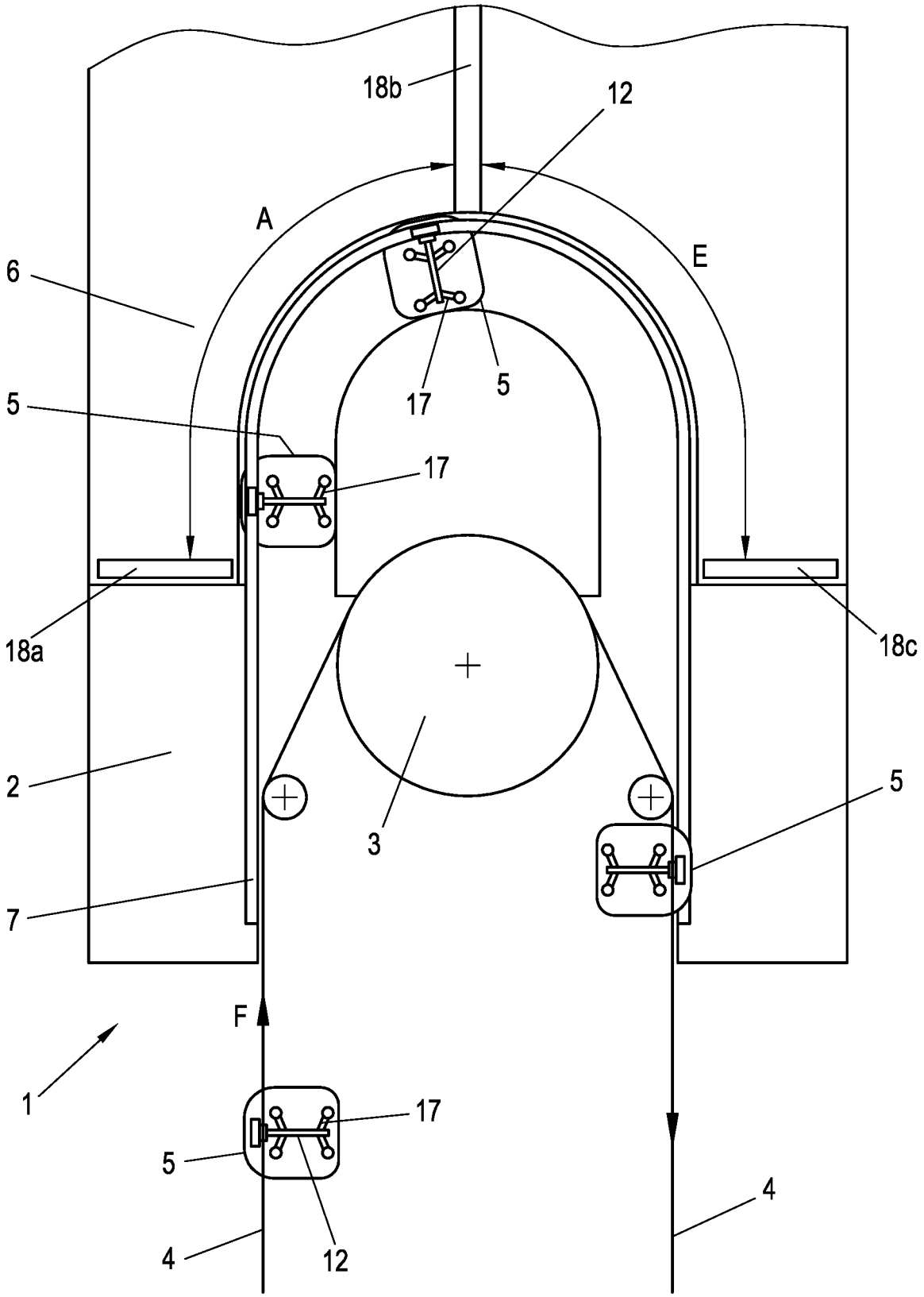
FIG. 1 is a schematic plan view of a cableway station of a cableway in a known design.

The structure and function of a cableway system is well known, which is why it is only briefly explained with reference to FIGS. 1 and 2 using the example of a circulating cable car transport system. FIG. 1 shows a cableway station 2 (for example, a mountain station or valley station) of the cableway 1. A pulley wheel 3 which guides the deflection of a circulating traction cable 4 of the cableway 1 is arranged in the cableway station 2. In at least one of the stations of the cableway 1, a pulley wheel 3 is driven in a known manner by a drive in order to allow the traction cable 4 to circulate in a loop around a pulley wheel of a further station. It is also known that the traction cable 4 is tensioned by a tensioning device acting on the pulley wheel 3. The cableway 1 is controlled by a cableway controller in the form of suitable hardware and software. For reasons of clarity and because they are irrelevant to the present teaching, these devices, which are known per se—in particular, the second station with the pulley wheel, drive, tensioning devices, cableway controller, etc.—are not shown. A cableway 1 can of course move a very large number of cableway vehicles 5 simultaneously with the traction cable 4, typically in the range of a few tens or a few hundred cableway vehicles 5, only a few of which are shown for the sake of simplicity. A platform 6 is also provided in the cableway station 2 in order to allow or facilitate the boarding and disembarking of persons to be transported or generally the loading and unloading of the cableway vehicles 5.

If the cableway 1 is not equipped with cableway vehicles 5 that are permanently clamped to the traction cable 4, a cableway vehicle 5 of the cableway 1 entering the cableway station 2 is decoupled from the traction cable 4, usually by means of a releasable cable clamp 10 (FIG. 2), and moved along a guide rail 7 through the cableway station 2, usually at a significantly lower speed than in the portion of the travel between the cableway stations 2. A conveyor 8 is provided along the guide rail 7, said conveyor moving the cableway vehicle 5 in the cableway station 2. The conveyor 8 is designed, for example, in the form of driven conveyor wheels 9 arranged in the cableway station 2, which wheels cooperate with a friction lining 11 on the cableway vehicle 5 in the cableway station 2. When the cableway vehicle 5 exits the cableway station 2, the cableway vehicle 5 is accelerated via the conveyor 8 at the exit and then coupled back to the traction cable 4, for example by means of a cable clamp 10.

The cableway 1 can be designed, for example, as a cable car transport system or cable gondola transport system in which cableway vehicles 5 have cable cars or gondolas that are guided along a platform 6. Passengers in the cableway station 2 can board or disembark from conventional cableway vehicles 5 via the platform 6. The cableway vehicle 5 could of course also be used for loading and unloading objects to be transported, for example winter sports equipment, bicycles, strollers, etc. A loading/unloading region is usually provided along a fixed portion of the platform 6 for persons to board or disembark and/or generally for loading/unloading. The loading/unloading region can, for example, be specially marked and separated from the rest of the region of the cableway station 2, for example by barriers 18, in which region access is not permitted for unauthorized persons.

For example, a common loading/unloading region could be provided in which both boarding/loading and disembarking/unloading take place. Usually, however, a separate loading region E and unloading region A are provided, which are separated from one another, as indicated in FIG. 1. This is advantageous because persons disembarking and persons boarding will not be in each other's way. For example, viewed in the direction of travel, a first barrier 18*a* can be arranged at the beginning of the unloading region A, and a second barrier 18*b* can be arranged at the end of the unloading region A. At the beginning of the loading region E, a barrier 18 can again be arranged, which, for example, can also be the second barrier 18*b* at the same time, and a third barrier 18*c* can be arranged at the end of the loading region E. The force-controlled opening of the doors of the cableway vehicle 5 can then take place, for example, in the region of the first barrier 18*a*, and the closing of the doors can take place in the region of the third barrier 18*c*. Of course, this is to be understood only as an example and the loading/unloading regions A, E could also be arranged differently.

Figure 2:
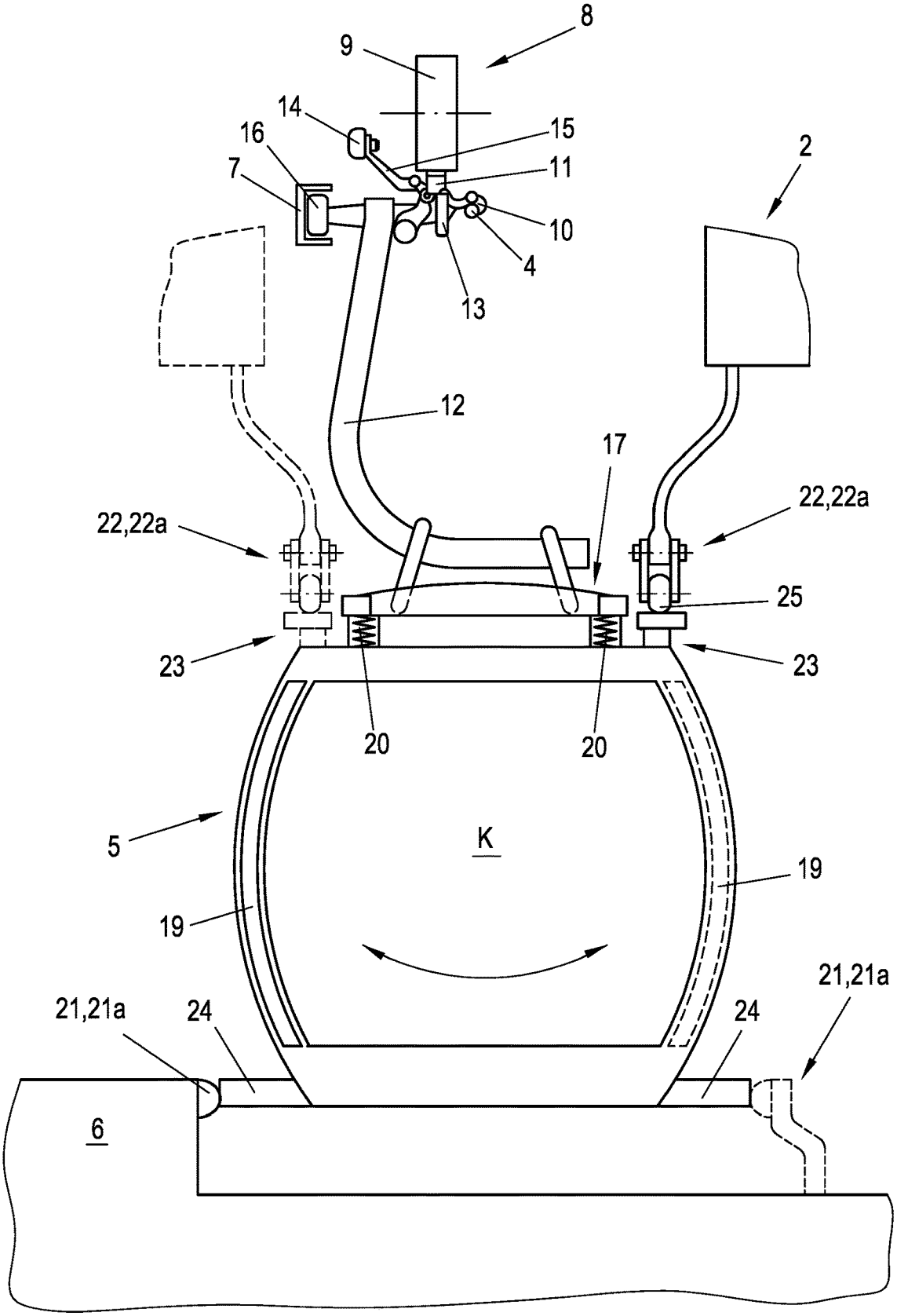
FIG. 2 shows a cableway vehicle of a cableway in the cableway station according to an advantageous embodiment of the present teaching in a view in the direction of travel.

In FIG. 2, a cableway vehicle 5 of the cableway 1 that can be detached from the traction cable 4 is shown in a cableway station 2 in a view in the direction of travel. The cableway vehicle 5 has a conveying body K and a suspension 17, the conveying body K being arranged on a hanger 12 of the cableway vehicle 5 by means of a suspension 17. The cableway vehicle 5 can be connected to the traction cable 4 via the hanger 12, for example suspended from the traction cable 4. The conveying body K is suspended in a spring-loaded manner from the suspension 17, so that the conveying body K is able to swing relative to the suspension 17. As a result, the comfort for the passengers can be increased, for example when driving over a roller battery of a cableway support, because any impacts that occur are cushioned. The spring-loaded suspension can take place, for example, via one or more spring units 20 which of course can also have damping properties if necessary. The cableway vehicle 5 can be connected to a traveling mechanism 13 via the hanger 12, which mechanism consists of at least one roller, for example. A cable clamp 10 can be arranged on the hanger 12, which cable clamp can clamp the traction cable 4 when a clamping spring acts thereon and which can be actuated mechanically via a coupling roller 14 and a clamp lever 15. The clamp lever 15 is actuated and the cable clamp 10 is opened via a guide link in the cableway station 2 which contacts the coupling roller 14 by means of the movement of the cableway vehicle 5. The cable clamp 10 is activated for the closing movement by a further guide link and is kept closed by the action of the clamping spring. A guide roller 16 which cooperates with the guide rail 7 in the cableway station 2 can also be arranged on the hanger 12. A friction lining 11 can also be arranged, which can cooperate with the conveyor 8, for example the rotating conveyor wheels 9, in order to move the uncoupled cableway vehicle 5 along the guide rail 7 through the cableway station 2.

Of course, other configurations of a cableway 1 and/or a cableway vehicle 5 are also conceivable; for example, a cableway 1 having cableway vehicles 5 permanently clamped to the traction cable 4 or having fixed cables to which the cableway vehicle 5 is attached via a traveling mechanism 13 and is moved by at least one traction cable 4. Likewise, the cableway 1 can be designed as a pendulum cableway with or without a fixed cable; i.e. with a traction cable 4 which travels back and forth, rather than a circulating traction cable 4. However, the specific design of the cableway 1 is irrelevant to the present teaching.

The cableway 1 shown is designed as a circulating cableway in the form of a cable car transport system, i.e. the conveying body K is a cable car in this case. Doors 19 are often only arranged in each case on one side of the cable cars of a cable car transport system, since the loading/unloading, for example the boarding/disembarking of persons via the platform 6, usually only takes place from one side. For example, in a mountain station of a circulating cableway, an unloading region A can first be provided, in which the passengers can disembark from the cable car, usually during the movement of the cableway vehicle 5, as shown in FIG. 1. After disembarking, the cableway vehicle 5 (usually with an empty cable car) is diverted and moved to a loading region E in which passengers can get in the cable car of the cableway vehicle 5 through the same door 19 for the downward journey. Of course, this is only an example and doors 19 can also be arranged on the cable cars on both sides in the transverse direction in the case of a circulating cableway, for example in order to first unload the cableway vehicle 5 on one side and then load it on the other side in each case, if platforms 6 are provided on both sides. Simultaneous loading and unloading would also be conceivable.

In a pendulum cableway, doors 19 are generally usually provided on both sides of the cable car. However, boarding and/or disembarking takes place usually only from one side. For example, in the case of a pendulum cableway, the door 19 on one side is often opened first for disembarking and the opposite door 19 is opened with a delay for boarding. The cableway vehicles 5 are therefore usually loaded on one side and off-center in the transverse direction when persons board and disembark, regardless of the specific design of the cableway (circulating cableway or pendulum cableway). The load also depends heavily on the number, weight and movement of the persons or the material and is therefore very irregular. So far, this has led to the cableway vehicle 5 being set into a pendulum movement in the transverse direction (indicated by the double arrow in FIG. 2) and in the longitudinal direction or direction of movement about the rest position thereof, which is generally perceived as unpleasant by the passengers. Such pendulum movements also increase the risk of passengers falling because the relative movement between the cableway vehicle 5 and the platform in the direction of movement (caused by the circulating movement through the cableway station 2) is superimposed by a relative movement in the transverse direction (the lateral pendulum movement) and by a pendulum movement in the longitudinal direction. In particular, this can make it difficult for passengers with winter sports equipment, such as ski boots, to board and disembark, which can result in falls and, in the worst case, in injuries. This also makes loading and unloading material more difficult.

In the example shown, a plurality of spring units 20 is provided between the suspension 17 and the conveying body K of the cableway vehicle 5, e.g. the cable car, with which spring units the conveying body K of the cableway vehicle 5 is spring-loaded, i.e. attached to the suspension 17 so that it is able to swing, as shown schematically in FIG. 2. The spring units 20 serve in particular to increase the comfort for the passengers during the journey. As a result, for example, unpleasant impacts on the conveying body K of the cableway vehicle 5 can be reduced, which impacts occur in the region of a cableway support when passing through a battery of rollers and are usually perceived as unpleasant by the passengers. However, in the cableway station 2, in which the cableway vehicles 5 are usually moved along the guide rail 7 decoupled from the traction cable 4, the spring units 20 can have a disadvantageous effect on the pendulum movements of the cableway vehicle 5 in the longitudinal and transverse directions and in particular amplify these movements, since the maximum deflection of the cableway vehicle 5 in the transverse direction is also increased by the spring deflection of the spring units 20 in the vertical direction. Of course, this also depends on the type and configuration of the spring units 20. In the simplest case, a spring unit 20 can be designed, for example, as a resilient buffer element, for example as a rubber buffer which also has certain damping properties. However, the spring unit 20 could also have suitable mechanical or pneumatic spring elements and mechanical, pneumatic or hydraulic damping elements in a known manner. Due to the weight of the persons boarding or disembarking, the conveying body K of the cableway vehicle 5 (in this case the cable car) in the cableway station 2 is lowered or raised due to the spring deflection of the spring units 20 relative to the suspension 17, which means an additional relative movement of the cableway vehicle 5 in a vertical direction to the platform 6. This can increase the pendulum movement and make boarding or disembarking and/or loading and unloading difficult.

The present teaching is intended to increase the safety of passengers when boarding or disembarking and, in general, to increase safety when loading/unloading the cableway vehicle 5 by reducing the pendulum movement of a cableway vehicle 5 in the transverse and longitudinal directions, at least in the region of the loading/unloading regions.

According to the present teaching, it is therefore provided that at least one vehicle-fixed contact rail 23 which extends in the direction of movement of the cableway vehicle 5 is arranged on the conveying body K and that at least one guiding portion FA having at least one stationary first guiding device 22 which extends in the direction of movement of the cableway vehicle 5 is provided in at least one cableway station 2 of the cableway 1. The first guiding device 22 cooperates, at least during the movement of the cableway vehicle 5 through the guiding portion FA, with the contact rail 23 of the cableway vehicle 5 arranged on the conveying body K in order to generate a guiding force. As a result, the guiding force shifts the conveying body K relative to the suspension 17 from a rest position, in which the cableway vehicle 5 can be moved outside of the guiding portion FA, into a guidance position, in which the cableway vehicle 5 can be moved through the guiding portion FA. The spring-loaded arrangement of the conveying body K on the suspension 17 of the cableway vehicle 5 is therefore deliberately used in order to shift the conveying body K from the rest position into a guidance position relative to the suspension 17 during the movement through the guiding portion FA. In the guidance position, due to the spring force of the spring unit(s) and/or due to gravity, a restoring force acts on the cableway vehicle 5, as a result of which the cableway vehicle 5 strives to return into the rest position. As a result, the stability of the cableway vehicle 5 in the transverse direction and in the longitudinal direction can be increased, as a result of which lateral swinging as well as swinging back and forth of the cableway vehicle 5, in particular of the conveying body K, can be reduced.

Figure 4:
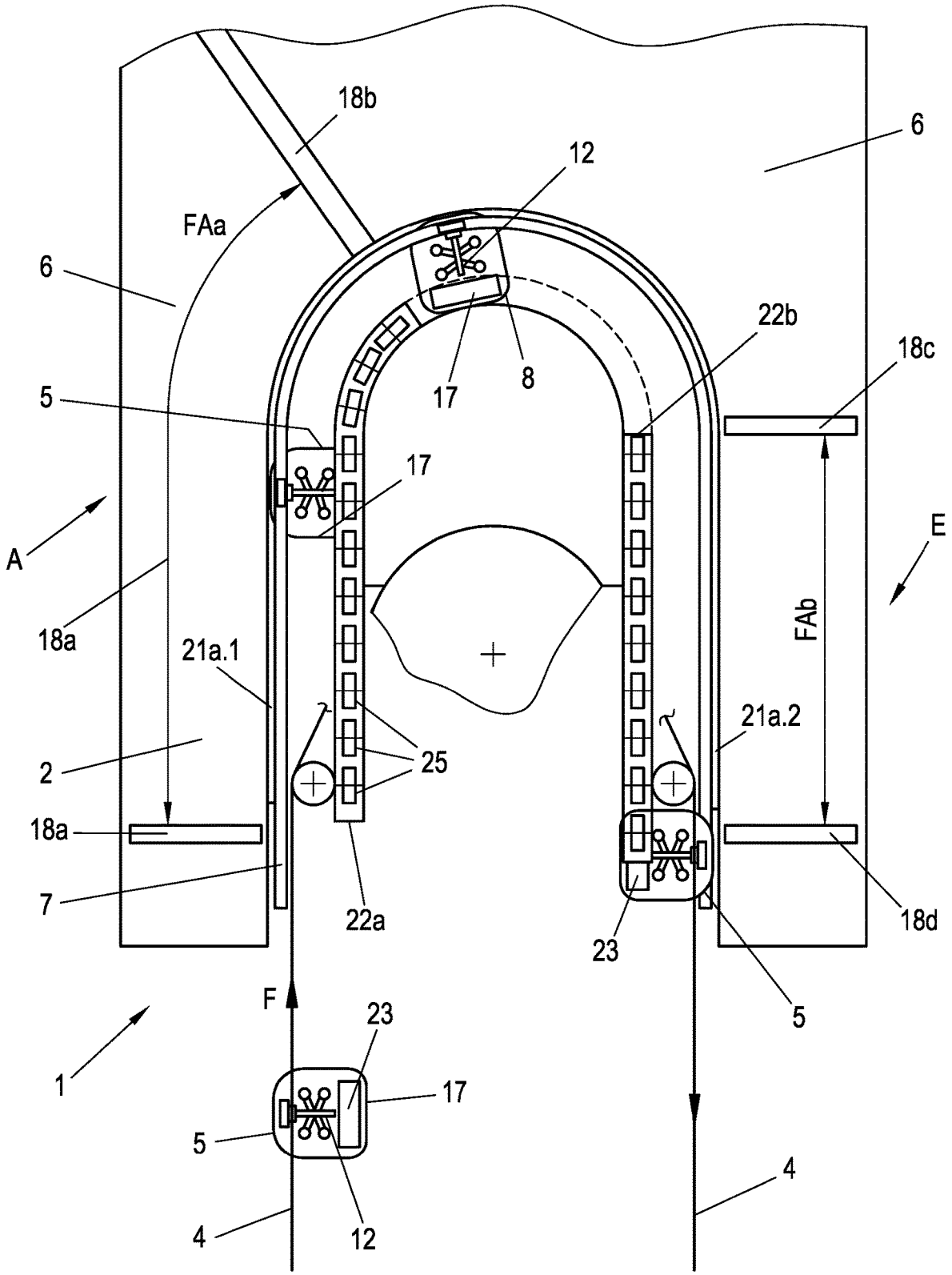
FIG. 4 shows a schematic cableway station of a cableway according to an advantageous embodiment of the present teaching in plan view.

In a circulating cableway, as shown in FIG. 4 for example, the cableway vehicle 5 is shifted into the guidance position relative to the suspension 17 during the movement through the guiding portion FAa or FAb and is moved in the guidance position through the corresponding guiding portion FAa, FAb. Loading/unloading usually takes place during movement in order to achieve the highest possible transport capacity. Of course, the loading/unloading could also take place when the cableway vehicle 5 is at standstill in the guidance position. At the end of the corresponding guiding portion FAa, FAb in the direction of movement, the cableway vehicle 5 is shifted back from the stabilizing guidance position into the rest position. A movement through the guiding portion FA is of course also to be understood as the movement of the cableway vehicle 5 of a pendulum cableway in the region of the guiding portion FA of the cableway station 2. In the case of the pendulum cableway, the cableway vehicle 5 would first be moved in the direction of movement into the specified guiding portion FA when driving in and then come to a standstill in the region of the guiding portion FA. After loading/unloading, the cableway vehicle 5 would be moved in the opposite direction out of the guiding portion FA in order to drive out from the cableway station 2.

At least one first guiding device 22 is preferably designed as a ceiling guide rail 22*a* which is arranged on a stationary structure in the upper region of the cableway station 2, as can be seen in FIG. 2. The contact rail 23 is accordingly arranged in an upper lateral region on the cableway vehicle 5 in order to interact with the ceiling guide rail 22*a* in the region of the guiding portion FA. The arrangement is advantageous because the region is difficult to access for persons, in particular passengers or cableway personnel, whereby safety is increased.

Furthermore, for improved stabilization of the cableway vehicle 5 in the transverse direction, at least one stationary second guiding device 21 which extends in the direction of movement of the cableway vehicle 5 can be provided in the guiding portion FA. The second guiding device 21 is arranged in such a way that the cableway vehicle 5 is deflected in the direction of the second guiding device 21 by means of the guiding force in the region of the guiding portion FA. The second guiding device 21 thereby cooperates with a part of the cableway vehicle 5 in the region of the guiding portion FA in order to guide the cableway vehicle 5, for example by the cableway vehicle 5 making contact with the second guiding device 21. At least one second guiding device 21 is preferably designed as a floor guide rail 21*a* which is arranged on a stationary structure in the lower region of the cableway station 2, as shown in FIG. 2. In this case, the floor guide rail 21*a* advantageously cooperates with a spacer element 24 arranged on the cableway vehicle 5, in particular on the conveying body K.

In the example according to FIGS. 2+3, a stationary floor guide rail 21*a* is arranged on the platform 6 along the platform 6 of the cableway station 2, and a stationary ceiling guide rail 22*a* is arranged on the opposite side (seen in the direction of travel) of the platform 6 in a region above a transit region for cableway vehicles 5 passing through. A vehicle-fixed contact rail 23 is arranged in an upper region of the conveying body K. The contact rail 23 is arranged in this case directly on the roof of the cable car, for example.

When driving through the cableway station 2, the contact rail 23 of the cableway vehicle 5 cooperates with the ceiling guide rail 22*a* in the region of the guiding portion FA, for example by the contact rail 23 being in contact with the ceiling guide rail 22*a*. The ceiling guide rail 22*a* and the contact rail 23 are designed in such a way that the conveying body K is pressed vertically downward in the region of the guiding portion FA by the ceiling guide rail 22*a* (shown on the right in FIG. 2) via the contact rail 23 on the right-hand side. Due to the guiding force acting on one side, the conveying body K is additionally pressed in each case in the transverse direction in the direction of or against the corresponding opposite floor guide rail 21*a*, viewed in the direction of travel (on the left in FIG. 2). As a result, the cableway vehicle 5 is forcibly guided in the region of the guiding portion FA substantially along the floor guide rail 21*a*, so that no or only very small pendulum movements are possible. As a result, this not only increases the objective safety of the passengers when boarding and disembarking, but also increases the subjective feeling of safety.

In the example shown in FIG. 2, the floor guide rail 21*a* is arranged on the side of the platform 6, and the ceiling guide rail 22*a* is arranged in a stationary position on the opposite side in a region above the cableway vehicles 5 passing through, for example on a suitable stationary structure of the cableway station 2. On the conveying body K, only one contact rail 23 is provided in this case on only one side. Of course, a reverse arrangement would also be possible, as indicated by dashed lines in FIG. 2. In this case, the floor guide rail 21*a* would be arranged on the opposite side of the platform 6, for example on a suitable stationary structure of the cableway station 2. The ceiling guide rail 22*a* would accordingly be arranged in a stationary manner on the side of the platform 6 above the platform 6. The contact rail 23 would also be arranged on the side of the cableway vehicle 5 facing the platform 6 on the conveying body K in order to contact the ceiling guide rail 22*a*. If the cableway vehicle 5, as shown, comprises a cable car as the conveying body K, the contact rail 23 can be arranged, for example, on the roof of the cable car.

However, two vehicle-fixed contact rails 23 which extend in the direction of movement of the cableway vehicle 5 and are spaced apart from one another transversely to the direction of movement could also be arranged on the conveying body K. For example, a contact rail 23 could be arranged in each case on the conveying body K on both sides of the cableway vehicle 5 (continuous lines on the right and dashed lines on the left in FIG. 2). This could be advantageous, for example, if a plurality of platforms 6 are provided one behind the other in the direction of movement and on opposite sides in the transverse direction in the cableway station 2. For example, an unloading region A having a platform 6 on one side (e.g., on the left in the direction of movement) and a subsequent loading region E having a platform 6 in each case on the corresponding opposite side (e.g. on the right in the direction of movement) could be provided one behind the other in the direction of movement. A door 19 for loading/unloading could then preferably be provided in each case on both sides of the cableway vehicle 5, in particular the cable car (indicated by dashed lines on the right in FIG. 2).

A first guiding portion FA could be assigned to the unloading region A, for example, which first guiding portion presses the cableway vehicle 5 in the direction of the platform 6 of the unloading region (to the left), and the subsequent loading region E could be provided with a second guiding portion FA having the floor guide rail 21*a* in a reverse arrangement relative to the first guiding portion FA and the ceiling guide rail 22*a*, which second guiding portion presses the cableway vehicle 5 toward the platform 6 of the loading region E (to the right). This embodiment could, for example, be advantageously provided at a middle station of a cableway 1 arranged between the mountain station and the valley station, since the cableway vehicles 5 do not turn in this station, but rather pass through on two sides (upward and downward journey). If contact rails 23 are arranged (seen in the direction of travel) on both sides of the cableway vehicle 5 (FIG. 2 dashed lines+continuous lines), then only one of the two contact rails 23 would cooperate with a ceiling guide rail 22*a* in each case, causing a vertical rebounding of the conveying body K relative to the suspension 17 in the region of the contact rail 23 and simultaneously a slight deflection of the conveying body K in the transverse direction, for example in the direction of a floor guide rail 21*a*.

However, a combination of both variants would also be conceivable, in which a floor guide rail 21*a* and a ceiling guide rail 22*a* are arranged on both sides in each case. In this case, however, only one contact rail 23 would be provided on the conveying body K (in this case, for example, above the door 19 of the cable car), which contact rail then, for example, only cooperates with the ceiling guide rail 22*a* above the platform 6 in order to press the cableway vehicle 5 against the opposite floor guide rail 21*a* (in this case in dashed lines). In this case, however, the contact rail 23 could also be arranged on the opposite side in the upper lateral region (in this case on the right) of the conveying body K (in this case, for example, on the roof of the cable car). The contact rail 23 would then cooperate with the ceiling guide rail 22*a* on the opposite side of the platform 6 and press the cableway vehicle 5 in the direction of the floor guide rail 21*a* arranged on the platform 6. As a result, different cableway vehicles 5 could be used, in which the contact rail 23 is arranged either on the side facing the platform 6 in the upper region of the conveying body K (in FIG. 2, for example, above the door 19 on the roof of the cable car) or on the opposite side in the upper part of the conveying body K.

The embodiment shown in FIG. 2, in which the floor guide rail 21*a* is arranged directly on the platform 6 and the ceiling guide rail 22*a* is arranged on the opposite side of the platform 6 in the upper region above the cableway vehicles 5 passing through, has the advantage that the conveying body K is pressed in the direction of the platform 6. As a result, the gap between the cableway vehicle 5, in particular the conveying body K, and the platform 6 or the floor guide rail 21*a* arranged thereon is minimized, in particular completely closed. As a result, safety during loading/unloading, in particular when persons board or disembark, can be further increased because, for example, the risk of objects falling into the gap or parts of winter sports equipment getting caught in it can be reduced.

In a lower region of the cableway vehicle 5, a spacer element 24 which cooperates with the second guiding device 21 in the region of the guiding portion FA is preferably also arranged, for example is in contact with the floor guide rail 21*a*, as shown on the left in FIG. 2. If the cableway vehicle 5 has a cable car as the conveying body K, it is particularly advantageous if the spacer element 24 is arranged on the cable car below the door and is designed as a footboard. As a result, it is not the cable car and the floor guide rail 21*a* that are in direct contact, but rather the floor guide rail 21*a* and the spacer element 24 or the footboard. As a result, for example, a smaller lateral deflection of the conveying body K in the direction of the floor guide rail 21*a* is required. Alternatively, or additionally, a spacer element 24 can also be arranged on the side of the cableway vehicle 5 opposite the platform 6, in this case for example on the side of the cable car opposite the door 19. If there is no door 19 on this side, the spacer element 24 does not have to be designed as a footboard, but could also be designed in any other way, for example in the form of a suitable rail or as a shaped tube that is attached to the cableway vehicle 5 at the appropriate distance in order to contact the floor guide rail 21*a* (in this case on the right) in the region of the guiding portion FA.

According to a further embodiment of the present teaching, it can be provided that at least two vehicle-fixed contact rails 23 which extend in the direction of movement of the cableway vehicle 5 and are spaced apart from one another transversely to the direction of movement are arranged on the conveying body K, and that at least two stationary first guiding devices 22 are additionally provided in at least one guiding portion FA. In each case, one of the first guiding devices 22 interacts with a corresponding contact rail 23 to generate the guiding force. The contact rails 23 could be arranged, for example, in the transverse direction on both sides of the cableway vehicle 5 in each case in the upper region of the conveying body K, in this case on the roof of the cable car, as shown in FIG. 2 (continuous lines and dashed lines). The two stationary first guiding devices 22 can accordingly be designed as ceiling guide rails 22*a* and simultaneously cooperate with the two contact rails 23 in order to shift the conveying body K relative to the suspension 17 into the guidance position.

In contrast to the previously described embodiments, the conveying body K is loaded in this case simultaneously at two positions in the transverse direction by the first guiding devices 22. The effect of this is that the conveying body K is pressed vertically downward on both sides in each case in the region of the contact rails 23 relative to the suspension 17 against the spring force or restoring force of the spring units 20. The restoring forces of the spring units 20 counteract this shifting, as a result of which the conveying body K is in a stable position. The swinging capacity of the conveying body K caused by the spring-loaded arrangement of the conveying body K on the suspension 17 (which is desired outside of the guiding portion FA) is deliberately limited as much as possible in the region of the guiding portion FA, in particular completely suppressed. As a result, lateral pendulum movements of the conveying body K are reliably reduced, preferably avoided. Due to the fact that the contact rails 23 cooperate with the corresponding first guiding device 22 over a relatively long range in the direction of movement, pendulum movements of the conveying body K in the direction of movement (swinging back and forth) are reliably reduced, preferably largely avoided. The second (double) embodiment has the advantage over the first (one-sided) embodiment that substantially no lateral deflection of the conveying body K takes place in the guiding portion FA. As a result, for example, the floor of a cable car can be aligned substantially parallel to the platform 6 during the movement of the cableway vehicle 5 through the guiding portion FA, as a result of which comfort when boarding or disembarking can be further increased.

Irrespective of the embodiment variant, at least one first guiding device 22 and/or at least one second guiding device 21 is preferably designed as a slide rail. Alternatively, or additionally, a plurality of rotatably mounted rollers 25 could also be arranged one behind the other in the direction of movement of the cableway vehicle 5 on at least one first guiding device 22 and/or on at least one second guiding device 21. As a result, the friction between the cableway vehicle 5 and the corresponding guiding device 21, 22 can be reduced during the passage of the cableway vehicle 5 through the guiding portion FA.

In the example shown in FIG. 2, a plurality of rollers 25 are arranged one behind the other so as to be rotatably mounted in the direction of movement of the cableway vehicle 5 on the ceiling guide rail 22*a*. As a result, when the cableway vehicle 5 passes through, the friction can be reduced by the rollers 25 rolling on the corresponding contact rail 23 of the cableway vehicle 5. This allows a smooth and low-noise guidance. For this purpose, for example, a suitable running surface for rolling the rollers 25 can also be provided on the contact rail 23. In general, the contact rail 23 is preferably made of a material with a sufficiently high strength, which material is also suitable for the weather conditions to be expected. For example, a suitable metal material or a suitable plastics material can be used for this purpose. However, the contact rail(s) 23 could, for example, also be integrated directly into the conveying body K, for example into the roof of the cable car. As a result, the contact rail 23 could, for example, run substantially flush with the roof of the cable car, which improves the visual appearance of the cableway vehicle 5 and makes cleaning easier.

Figure 3:
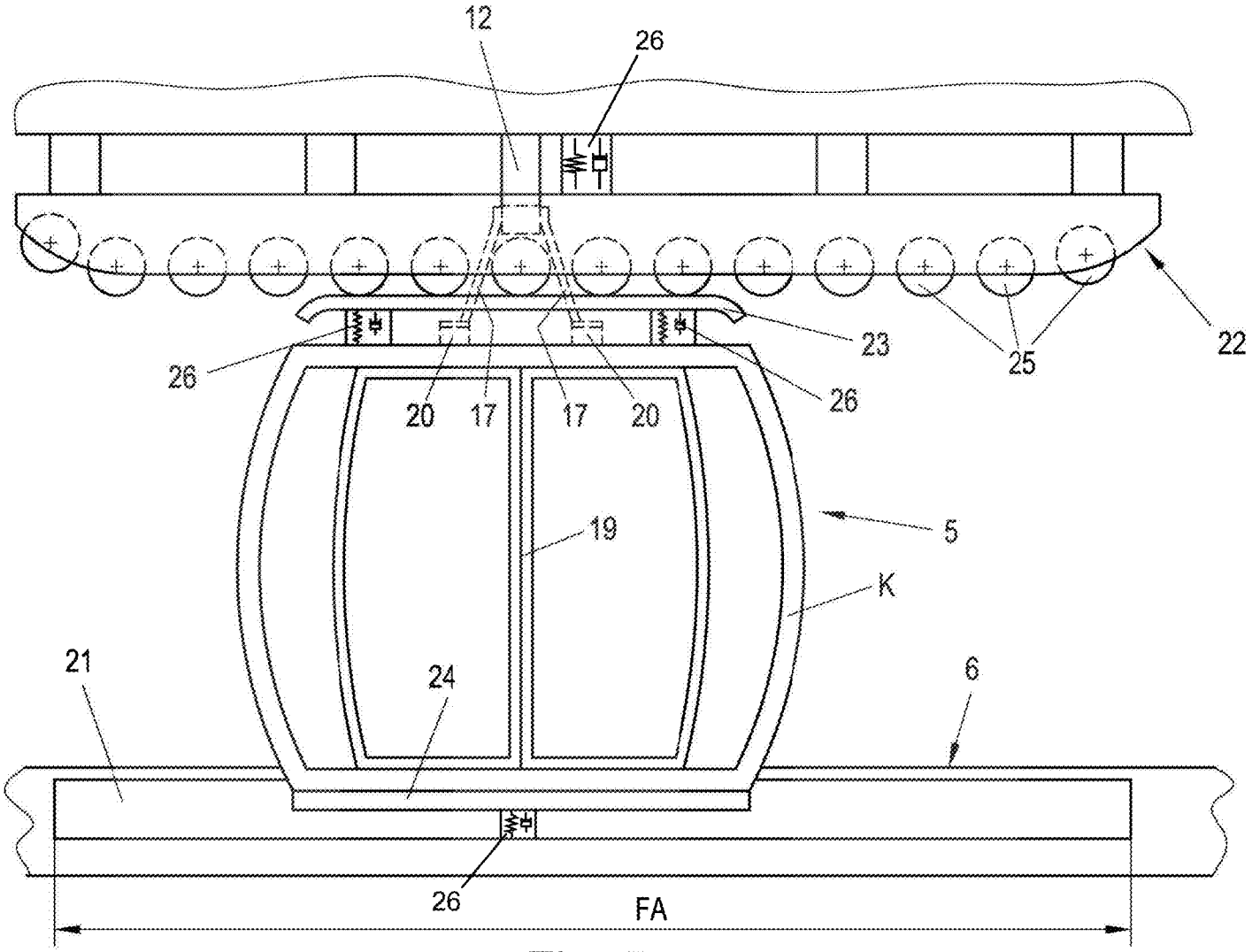
FIG. 3 shows the cableway vehicle from FIG. 2 in a side view.

FIG. 3 shows the cableway vehicle 5 from FIG. 2 in a side view from the opposite side of the platform 6 (from the right in FIG. 2). In this representation, the cooperation of the stationary ceiling guide rail 22*a* of the cableway station 2 with the vehicle-fixed contact rail 23 of the cableway vehicle 5 is clearly visible. The floor guide rail 21*a* is designed in this case as a slide rail along which the cableway vehicle 5 slides in the region of the guiding portion FA, preferably with the spacer element 24 attached thereto. For this purpose, for example, a suitable sliding lining can be provided on the slide rail and/or on the component, for example the spacer element 24, of the cableway vehicle 5, which component is in contact therewith. Materials that are suitable for minimizing friction and allowing a sliding movement that is as quiet as possible, for example plastics material, are advantageously used as the sliding lining. As an alternative to the slide rail, a plurality of rollers (not shown) can also be arranged one behind the other in the direction of movement on the floor guide rail 21*a*, analogously to the ceiling guide rail 22*a*.

The rollers would then roll on the cableway vehicle 5, preferably on the spacer element 24 arranged thereon. In order to reduce the mechanical loads on the cableway vehicle 5 and/or on a guiding device 21, 22 and to increase comfort for the passengers, a damping apparatus (not shown) may be provided, according to a further advantageous embodiment of the present teaching, on at least one first guiding device 22 and/or on at least one second guiding device 21. Alternatively, or additionally, a damping apparatus 26 could also be provided on at least one contact rail 23. In a known manner, the damping apparatus can comprise, for example, a mechanical spring or gas spring and a mechanical, pneumatic, or hydraulic damper. In the simplest case, for example, a suitable buffer element such as a rubber buffer could also be provided. The damping apparatus 26 shown in FIG. 3 serves to cushion and damp vertical movements of the cableway vehicle 5, which movements occur in particular when the cableway vehicle 5 enters the guiding portion FA.

As a result, hard impacts on the cableway vehicle 5 caused by the contact rail 23 hitting the ceiling guide rail 22*a* hard can be avoided. In a similar way, a damping apparatus (not shown) could of course also be arranged on the floor guide rail 21*a* alternatively or additionally, in order to cushion and dampen horizontal movements of the cableway vehicle 5 in the region of the guiding portion FA. The damping apparatus 26 should have a sufficiently soft damping characteristic so that impacts are reliably absorbed, but should also be sufficiently hard so that pendulum swinging motions of the cableway vehicle 5 are reliably suppressed. Any damping apparatuses 26 on contact rails 23 and/or on the guiding devices 21, 22 should therefore be designed to be relatively rigid in comparison to the spring-loaded suspension (e.g., the spring units 20) of the conveying body K on the suspension 17. A sliding lining that has certain spring/damping properties could also be used for the slide rail.

As shown in FIG. 3, the contact rail 23 can also have rounded ends, viewed in the direction of movement. Alternatively, or additionally, the first guiding device 22 can also have rounded ends, as viewed in the direction of movement. This is advantageous because, at the beginning of the guiding portion FA, a contact pressure on the cableway vehicle 5 which continuously increases in the direction of movement is achieved. As a result, the conveying body K is not abruptly but rather continuously shifted from the rest position into the guidance position, which means that comfort can be improved. In the same way, a continuously falling contact pressure can be achieved at the end of the guiding portion FA. In the example shown, both the ceiling guide rail 22*a* and the contact rail 23 are rounded. In principle, however, it would also be sufficient if only the contact rail 23 or the ceiling guide rail 22*a* has curved ends. In the example shown, two damping apparatuses 26 are arranged between the contact rail 23 and the cableway vehicle 5, in this case the roof of the cable car, the function of which has already been described. It can also be seen in FIG. 3 that the contact rail(s) 23 extend(s) over a relatively large region of the conveying body K in the direction of movement. The length of the contact rails 23 is chosen so that the contact with the corresponding first guiding devices 22 takes place over a sufficiently large length, so that pendulum movements of the conveying body K in the direction of movement (swinging back and forth) can be reliably avoided.

As has already been explained, the conveying body K of the cableway vehicle 5 is spring-loaded, for example by means of at least one suspension 20, i.e. is attached to the suspension 17 so that it is able to swing, in order to increase the comfort for the passengers during the journey. In the example shown, four spring units 20 are arranged between the suspension 17 and the conveying body K (the cable car), as can be seen in FIG. 2 in conjunction with FIG. 3. Through the cooperation of the ceiling guide rail 22*a* and the contact rail 23 arranged on the cable car, the spring units 20 in the region of the guiding portion FA are preferably prestressed in such a way that when persons board or disembark or generally when loading/unloading the cableway vehicle 5, no or only very few small pendulum movements of the cableway vehicle 5 and/or only a slight sinking of the cableway vehicle 5 due to the weight of the load is/are possible.

In the one-sided variant, the conveying body K is pressed downward on one side relative to the suspension 17 by the cooperation of the contact rail 23 with the first guiding device 22 of the cableway station 2. As a result, the spring units 20 are decompressed on the corresponding side and thereby prestressed. The spring units 20 on the corresponding other side are correspondingly compressed because the conveying body K on this side moves upward relative to the suspension 17 due to a torque generated by the guiding force. In the example shown according to FIGS. 2 and 3, the ceiling guide rail 22*a* and the contact rail 23 (and possibly the floor guide rail 21*a*) could be designed so that the platform-side spring unit(s) 20 (on the left in FIG. 2) are compressed as far as possible in the vertical direction and the spring unit(s) 20 (on the right in FIG. 2) opposite the platform 6 are pulled apart as far as possible in the vertical direction. This substantially blocks the otherwise advantageous swinging suspension of the conveying body K (during the journey between the cableway stations 2) on the suspension 17 in the region of the guiding portion FA, so that the cableway vehicle 5 can be moved through the guiding portion FA as free as possible from disruptive pendulum movements.

In the two-sided variant, the conveying body K is pressed downward on both sides relative to the suspension 17 by the cooperation of the contact rails 23 with the ceiling guide rails 22*a* of the cableway station 2, said contact rails being spaced apart in the transverse direction. As a result, the spring units 20 are decompressed on both sides and thereby prestressed. The ceiling guide rails 22*a* and the contact rails 23 in FIG. 2 (dashed lines and continuous lines) are preferably designed so that the platform-side spring unit(s) 20 (on the left in FIG. 2) and the spring unit(s) 20 (on the right in FIG. 2) opposite the platform 6 are pulled apart as far as possible in the vertical direction, so that the restoring forces of the spring units 20 stabilize the conveying body K. This substantially blocks the resilient suspension of the conveying body K on the suspension 17 in the region of the guiding portion FA, so that the cableway vehicle 5 can be moved through the guiding portion FA as free as possible from disruptive pendulum movements.

FIG. 4 shows a cableway station 2 according to the present teaching of a circulating cableway designed as a cable car transport system, the basic design of which substantially corresponds to the cableway station according to FIG. 1. The direction of movement of the traction cable 4 and thus the direction of movement of the cableway vehicle 5 is indicated by the arrows. Accordingly, a disembarking region or, in general, an unloading region A is provided between two barriers 18*a*, 18*b* on the left of the platform 6. A boarding region or, in general, a loading region E is provided between two barriers 18*c*, 18*d* on the right of the platform 6. For example, the unloading region A extends partly over the straight region of the platform 6 and partly into the curved region of the platform 6 in this case. The loading region E extends in this case only along the straight portion of platform 6. Of course, this is to be understood only as an example, and any other arrangement could also be provided.

A first guiding portion FAa is provided in the unloading region A, and a second guiding portion FAb is provided in the loading region E. The guiding portions FAa, FAb are designed in this case according to the first embodiment, i.e. each have a one-sided stationary first guiding device 22 and a stationary second guiding device 21 arranged on one side, as explained with reference to FIGS. 2+3. A first floor guide rail 21*a*.1 is arranged on the platform 6 in the unloading region A, and a second floor guide rail 21*a*.2 is arranged on the platform 6 in the loading region A. Opposite the platform 6 of the unloading region A, a first ceiling guide rail 22*a*.1 is arranged in an upper region of the cableway station 2 above the cableway vehicles 5 passing through, and, opposite the platform of the loading region E, a second ceiling guide rail 22*a*.2 is arranged in the upper region. For better visibility, the traction cable 4 and the pulley wheel 3 are shown broken away in the region of the ceiling guide rails 22*a*.1, 22*a*.2. Only one contact rail 23 is arranged on each of the conveying bodies K of the cableway vehicles 5.

A plurality of rollers 25 is arranged in each case one behind the other in the direction of movement on both ceiling guide rails 22*a*.1, 22*a*.2, which rollers cooperate with the contact rail 23 of the cableway vehicle 5 located in the corresponding guiding portion FAa, FAb, in particular rolls thereon. As a result, the corresponding cableway vehicle 5 is pressed in the direction of or against the floor guide rail 21*a*.1, 21*a*.2, as described. The ceiling guide rails 22*a*.1, 22*a*.2 run parallel to the corresponding platform 6, with the first ceiling guide rail 22*a*.1 extending into the curved region and correspondingly having a curvature. As indicated by the dashed line between the two ceiling guide rails 22*a*. 1, 22*a*.2 in FIG. 4, instead of two separate ceiling guide rails 22*a*.1, 22*a*.2, a single continuous ceiling guide rail could of course also be provided, and a single continuous floor guide rail could analogously be provided on the platform 6.

The embodiments described with reference to FIGS. 1-4 are of course to be understood only as examples and are not to be understood as limiting the present teaching. For example, the present teaching is not limited to the circulating cableway shown but could of course also be used for other designs of cableways, for example pendulum cableways. The cableway vehicles 5 can also be designed in any other way. Essential to the present teaching is the functional principle according to which pendulum movements of the conveying body K are reduced in the longitudinal and transverse direction in the region of the guiding portion FA, by at least one stationary first guiding device 22 of the cableway station 2 cooperating with a vehicle-fixed contact rail 23 of the cableway vehicle 5 arranged on the conveying body K in order to exert a guiding force on the conveying body K, which guiding force shifts the conveying body K from a rest position (outside of the guiding portion FA) into a guidance position within the guiding portion FA. The specific constructive implementation is at the discretion of a person skilled in the art.

The invention claimed is:

1. A cableway having at least two cableway stations and at least one cableway vehicle that can be moved between the cableway stations using a traction cable, the cableway vehicle having a conveying body and a suspension, the conveying body serving to accommodate persons and/or objects and the conveying body being suspended on the suspension, at least one vehicle-fixed contact rail which extends in the direction of movement of the cableway vehicle being arranged on the conveying body, and at least one guiding portion having at least one stationary first guiding device which extends in the direction of movement of the cableway vehicle being provided in at least one cableway station, wherein the conveying body is suspended in a spring-loaded manner on the suspension and in that the first guiding device cooperates with the contact rail of the cableway vehicle, at least during the movement of the cableway vehicle through the guiding portion, in order to generate a guiding force, the guiding force shifting the conveying body relative to the suspension from a rest position, in which the cableway vehicle can be moved outside of the guiding portion, into a guidance position, in which the cableway vehicle can be moved through the guiding portion.

2. The cableway according to claim 1, wherein said at least one vehicle-fixed contact rail comprising at least two vehicle-fixed contact rails which extend in the direction of movement of the cableway vehicle and are spaced apart from one another transversely to the direction of movement are arranged on the conveying body and in that said at least one stationary first guiding device comprising at least two stationary first guiding devices are provided in at least one guiding portion, in each case one of the first guiding devices cooperating with a contact rail in order to generate the guiding force.

3. The cableway according to either claim 1, wherein said at least one first guiding device is designed as a ceiling guide rail which is arranged on a stationary structure in the upper region of the cableway station, and in that the corresponding contact rail is arranged in an upper lateral region on the conveying body.

4. The cableway according to claim 1, wherein preferably said at least one guiding portion is provided with at least one stationary second guiding device which extends in the direction of movement of the cableway vehicle, with the conveying body being deflected in the direction of the second guiding device by means of the guiding force in the region of the guiding portion, the second guiding device cooperating with the cableway vehicle in the region of the guiding portion to guide the cableway vehicle.

5. The cableway according to claim 4, wherein said at least one second guiding device is designed as a floor guide rail which is arranged on a stationary structure in the lower region of the cableway station 2.

6. The cableway according to claim 1, wherein said at least one first guiding device is designed as a slide rail and/or in that at least one second guiding device is designed as a slide rail, and/or in that a plurality of rotatably mounted rollers are arranged one behind the other in the direction of movement of the cableway vehicle on said at least one first guiding device, and/or in that a plurality of rotatably mounted rollers are arranged one behind the other in the direction of movement of the cableway vehicle on said at least one second guiding device.

7. The cableway according to claim 1, wherein said at least one first guiding device and/or said at least one second guiding device has a damping apparatus, and/or in that the at least one contact rail has a damping apparatus.

8. The cableway according to claim 1, wherein the conveying body is designed as a cable car.

9. A method for operating a cableway having at least two cableway stations and at least one cableway vehicle that can be moved between the cableway stations using a traction cable, the cableway vehicle having a conveying body and a suspension, the conveying body serving to accommodate persons and/or objects and the conveying body being suspended on the suspension, the cableway vehicle being moved in a guiding portion of a cableway station, a stationary first guiding device of the cableway station, which guiding device extends in the direction of movement of the cableway vehicle, cooperating, during the movement of the cableway vehicle through the guiding portion, with a vehicle-fixed contact rail which is arranged on the conveying body and which extends in the direction of movement of the cableway, wherein the conveying body is suspended in a spring-loaded manner on the suspension, and in that the first guiding device and the contact rail cooperate in order to generate a guiding force by means of which the conveying body is moved, during the movement through the guiding portion, relative to the suspension from a rest position, in which the cableway vehicle is moved outside of the guiding portion, into a guidance position, in which the cableway vehicle is moved through the guiding portion.

10. The method according to claim 9, wherein two said stationary first guiding devices of the cableway station, which guiding devices extend in the direction of movement of the cableway vehicle, cooperate, during the movement of the cableway vehicle through the guiding portion, with two said vehicle-fixed contact rails, which are arranged on the conveying body so as to be spaced apart transverse to the direction of movement and which extend in the direction of movement of the cableway, in order to generate the guiding force, in each case one of the first guiding devices cooperating with one of the contact rails.

11. The method according to claim 9, wherein a ceiling guide rail is used as the first guiding device, which ceiling guide rail is arranged on a stationary structure in the upper region of the cableway station, and in that the corresponding contact rail is arranged in an upper lateral region on the cableway vehicle.

12. The method according to claim 9, wherein in the region of the guiding portion, the conveying body is deflected, by means of the guiding force, in the direction of a stationary second guiding device which is arranged in the guiding portion and extends in the direction of movement of the cableway vehicle, the second guiding device in the region of the guiding portion cooperating with the cableway vehicle in order to guide the cableway vehicle.

13. The method according to claim 9, wherein a floor guide rail is used as a second guiding device, which floor guide rail is arranged on a stationary structure in the lower region of the cableway station.

14. The method according to claim 9, wherein a slide rail is used as said at least one first guiding device and/or as at least one second guiding device, and/or in that a plurality of rotatably mounted rollers are arranged one behind the other in the direction of movement of the cableway vehicle on said at least one first guiding device and/or on said at least one second guiding device.

15. The method according to claim 9, wherein a damping apparatus is provided on at least one first guiding device and/or on at least one second guiding device, and/or in that the at least one contact rail is arranged on the conveying body by means of at least one damping apparatus.

16. The method according to claim 9, wherein, in a lower region of the cableway, at least one spacer element which cooperates with a second guiding device in the region of the guiding portion is arranged on at least one side in order to guide the cableway vehicle.

17. The method according to claim 9, wherein a cable car is used as the conveying body.

* * * * *